US009234411B2

(12) United States Patent
Mao

(10) Patent No.: US 9,234,411 B2
(45) Date of Patent: Jan. 12, 2016

(54) TOWER FRAME COMBINED TRANSMITTING PUMPING UNIT WITHOUT GUIDING WHEELS

(75) Inventor: Hongwei Mao, Beijing (CN)

(73) Assignee: International Business Alliance Management, Inc., Sherman Oaks, CA (US)

( * ) Notice: Subject to any disclaimer, the term of this patent is extended or adjusted under 35 U.S.C. 154(b) by 746 days.

(21) Appl. No.: 13/521,350

(22) PCT Filed: Feb. 9, 2010

(86) PCT No.: PCT/CN2010/070586

§ 371 (c)(1),
(2), (4) Date: Jul. 10, 2012

(87) PCT Pub. No.: WO2011/082557

PCT Pub. Date: Jul. 14, 2011

(65) Prior Publication Data

US 2013/0058803 A1 Mar. 7, 2013

(30) Foreign Application Priority Data

Jan. 11, 2010 (CN) ..... 2010 1 000486

(51) Int. Cl.
*E21B 43/12* (2006.01)
*E21B 15/00* (2006.01)

(52) U.S. Cl.
CPC ..... *E21B 43/127* (2013.01); *E21B 15/003* (2013.01); *E21B 43/126* (2013.01); *E21B 2043/125* (2013.01)

(58) Field of Classification Search
CPC ..... F04B 9/02; F04B 9/06; F04B 35/01; F04B 35/04; F04B 47/00; F04B 47/02; F04B 47/14; F04B 47/022; F04B 47/028; F04B 47/145; F04B 49/06; F04B 49/20; E21B 15/003; E21B 43/126; E21B 43/127; E21B 2043/125; F16H 1/04; F16H 1/06; F16H 7/023; F16H 7/06
See application file for complete search history.

(56) References Cited

U.S. PATENT DOCUMENTS 3,695,117 A * 10/1972 Ewing ..... F16H 19/0659 74/89.22
4,665,761 A * 5/1987 Bao ..... E21B 43/126 74/41
4,889,023 A * 12/1989 Languillat ..... B26D 3/164 493/288
6,015,775 A * 1/2000 Takayama ..... B22F 3/24 419/8
8,047,821 B2 * 11/2011 Gu ..... E21B 43/126 166/105
2008/0128124 A1 * 6/2008 Jin ..... E21B 43/127 166/105
2010/0054895 A1 * 3/2010 Anderson ..... E21B 19/00 414/22.51

* cited by examiner

*Primary Examiner* — Justin Jonaitis
*Assistant Examiner* — Charles Nichols
(74) *Attorney, Agent, or Firm* — Kelly & Kelley, LLP

(57) ABSTRACT

A tower frame combined transmitting pumping unit without guiding wheels includes a tower frame, a powering system, a transmitting system, a controlling system, a balancing weight box, a weight hauling cable, a rope wheel, a driving rope and rope hangers. The rope wheel is fixed on a side of an operation platform through a rope wheel supporting device. A central axis line of the rope wheel is located within the operation platform. A wheel rim of the rope wheel extends beyond the operation platform and a minimum distance between a most external rim thereof. The weight hauling cable and the driving rope twine around the rope wheel reversely. A free end of the weight hauling cable is connected to the balancing weight box through a rope hanger A. A platform moving device is installed between the operation platform and a top of the tower frame.

12 Claims, 6 Drawing Sheets

TOWER FRAME COMBINED TRANSMITTING PUMPING UNIT WITHOUT GUIDING WHEELS

CROSS REFERENCE OF RELATED APPLICATION

This is a U.S. National Stage under 35 USC 371 of the International Application PCT/CN2010/070586, filed on Feb. 9, 2010.

BACKGROUND OF THE PRESENT INVENTION

1. Field of Invention

The present invention relates to a mechanical device for exploiting oil, and more particularly to a tower frame pumping unit.

2. Description of Related Arts

In the field of exploiting oil, the beam pumping unit is gradually replaced by the tower frame pumping unit because the tower frame pumping unit has a simple structure, low costs, small energy consumption and etc. However, some mutually related technical problems existing in the tower frame pumping unit affects and limits wider promotion and application thereof. The two most predominant technical problems are the method for giving space to drill and the duration of steel wires. Before drilling, in order to save enough space for the drilling devices to operate at the well mouth, a minimum distance between the tower frame and the well mouth should be kept more than 700 mm. Thus two most common methods for giving space to drill are as follows. The first one is to set the whole tower frame movable. Before drilling, the whole tower frame is dragged away from the well mouth by traction devices. Because main devices of the tower frame pumping unit are provided on the top of the tower frame to form a relatively high center of gravity, it is time-consuming, energy-consuming and relatively insecure to integrally move the tower frame. The second one is to provide a guiding wheel extending outwardly at the top of the tower frame. A distance at which the guiding wheel extends outwardly can be adjusted based on practical needs, so the distance between the tower frame and the well mouth is possibly kept longer than 700 mm during installing the tower frame. Considering stability and costs of the tower frame, usually a diameter of the guiding wheel is relatively small; moreover, the duration of the steel wires is closely related with a bending diameter thereof, and the steel wires continuously passes a rope wheel and the guiding wheel in a short distance, so that the steel wires continuously bend twice under a condition that stresses thereof are not completely removed, which accelerates damaging the steel wires. FIG. 1 shows a diagram of duration factors relative to bending fatigue of the steel wires. Supposing that a ratio of a bending diameter D of the steel wires to a diameter d of the steel wires is 62 and the duration factor of the steel wires is 1, the bigger ratio, the longer duration. Conventionally, a tower frame pumping unit with a load within 12 tons has a ratio of the diameter of the guiding wheel to the diameter of the steel wires only around 40 to 50; a tower frame pumping unit with a load over 12 tons has a ratio of the diameter of the guiding wheel to the diameter of the steel wires only around 25 to 35. Thus a relatively small diameter of the guiding wheel leads to a relatively short duration of the steel wires. Some conventional tower frame pumping units use belts to replace the steel wires to solve the problem of the duration of the steel wires, but the belts would shake violently under actions of winds, which tends to damage a suction rod of the pumping unit and the well mouth. The conventional tower frame pumping units fail to simultaneously overcome the above technical problems.

SUMMARY OF THE PRESENT INVENTION

An object of the present invention is to provide a tower frame combined transmitting pumping unit without guiding wheels whose method for giving space to drill is safe and simple and whose duration of steel wires is relatively long.

A tower frame transmitting pumping unit without guiding wheels of the present invention comprises a tower frame, a powering system, a transmitting system, a controlling system, a balancing weight box, a weight hauling cable, a rope wheel, a driving rope and rope hangers. The powering system, the transmitting system, the controlling system and the rope wheel are installed on an operation platform at a top of the tower frame. The controlling system, connected to the powering system, is for controlling a commutation position and a rotating speed of the powering system. The powering system is transmittedly connected to the rope wheel through the transmitting system, wherein the rope wheel is fixed on a side of the operation platform through a rope wheel supporting device. A central axis line of the rope wheel is located within an edge of the operation platform. A minimum distance between the central axis line and the edge of the operation platform along a horizontal direction is counted as L. A wheel rim of the rope wheel extends beyond the operation platform and a minimum distance between a most external rim thereof and the tower frame along a horizontal direction is counted as M. The rope wheel has several fixing holes. An end of the weight hauling cable is fixed on a first group of the fixing holes and an end of the driving rope is fixed on a second group of the fixing holes. The weight hauling cable and the driving rope twine around the rope wheel reversely. A free end of the weight hauling cable is connected to the balancing weight box through a first rope hanger A. A hanging part of the weight hauling cable is located at a longitudinal center of the tower frame. A free end of the driving rope is connected to the suction rod through a second rope hanger B. A platform moving device is provided between the operation platform and the top of the tower frame, wherein L is not smaller than 50 mm and M is not smaller than 700 mm.

In the tower frame transmitting pumping unit without guiding wheels of the present invention, the platform moving device comprises sliding tracks formed by round pipes and sliding sleeves, wherein the sliding tracks are mounted at the top of the tower frame and the sliding sleeve is connected to a bottom of the operation platform through a connecting board at a top of the sliding sleeve. The sliding sleeves are provided on the sliding tracks formed by round pipes to be able to slide on the sliding tracks formed by round pipes.

In the tower frame transmitting pumping unit without guiding wheels of the present invention, copper sleeves are further provided between the sliding sleeves and the sliding tracks formed by round pipes; the copper sleeves are connected to an internal wall of the sliding sleeves; and lubricant is applied between the copper sleeves and the sliding tracks formed by round pipes.

In the tower frame transmitting pumping unit without guiding wheels of the present invention, the platform moving device comprises jackscrews, pulleys and first sliding tracks, wherein the jackscrews are uprightly installed in the operation platform; a lower end of the jackscrew is connected to a rotation axle of the pulley; the first sliding tracks are fixedly connected to the top of the tower frame; and the first sliding tracks and the pulleys are mutually compatible.

In the tower frame transmitting pumping unit without guiding wheels of the present invention, the platform moving device comprises second sliding tracks and sliding blocks, wherein the second sliding tracks are fixedly connected to the top of the tower frame; the operation platform is provided on the second sliding tracks; the sliding blocks are provided between the operation platform and the second sliding tracks; the sliding blocks are fixedly connected to the second sliding tracks or the bottom of the operation platform; the sliding blocks are made of highly lubricant and abrasion resistant metals or engineering plastic.

In the tower frame transmitting pumping unit without guiding wheels of the present invention, an operation platform positioning board is provided at the top of the tower frame and installed on the first sliding tracks, the second sliding tracks or the sliding tracks formed by round pipes to be movable.

In the tower frame transmitting pumping unit without guiding wheels of the present invention, the transmitting system comprises a first chain wheel E, a second chain wheel F, a transmitting shaft, a small gear, a big gear ring and a rope wheel shaft. An outputting terminal of the powering system is fixedly connected to the first chain wheel E. The first chain wheel E drives the second chain wheel F through a chain. The second chain wheel F is mounted on a first end of the transmitting shaft. The small gear is mounted on a second end of the transmitting shaft. The transmitting shaft is installed on a transmitting shaft holder through a first pair of bearings G. The big gear ring is mounted at a central part of an external side of the rope wheel. The rope wheel is installed on the rope wheel shaft through a second pair of bearings H. Two ends of the rope wheel shaft are respectively fixed on a shaft seat. The shaft seat is fixed on the operation platform. The rope wheel shaft, the second pair of bearings H and the shaft seat form the rope wheel supporting devices. The small gear and the big gear ring engage with each other.

In the tower frame transmitting pumping unit without guiding wheels of the present invention, the transmitting system comprises a transmitting belt, a small belt chain wheel, a big belt chain wheel, a transmitting shaft, a small gear, a big gear and a rope wheel shaft. An outputting terminal of the powering system is fixedly connected to the small belt chain wheel. The small belt chain wheel drives the big belt chain wheel through the transmitting belt. The big belt chain wheel is mounted on a first end of the transmitting shaft. The small gear is mounted on a second end of the transmitting shaft. The transmitting shaft is installed on the transmitting shaft holder through a first pair of bearings C. The small gear and the big gear engage with each other. The big gear is mounted on an end of the rope wheel through a dowel. The rope wheel shaft is installed on an internal part of the rope wheel through a second pair of bearings I. Two ends of the rope wheel shaft are respectively fixed on a shaft seat. The shaft seat is fixed on the operation platform. The rope wheel shaft, the second pair of bearings I and the shaft seat form a rope wheel supporting device.

In the tower frame transmitting pumping unit without guiding wheels of the present invention, a hydraulic piston cylinder is installed between the top of the tower frame and the operation platform; the piston cylinder is hinged on the top of the tower frame; an end of a piston rod thereof is hinged on the operation platform.

In the tower frame transmitting pumping unit without guiding wheels of the present invention, the balancing weight box has a major weight box and a plurality of vice weight blocks of multiple levels, wherein the plurality of vice weight blocks are attached to the major weight box through hangers installed at two sides of the major weight box; cement, sand and iron are provided in the major weight box and the plurality of vice weight blocks; and a total weight of the plurality of vice weight blocks is smaller than 10% of a total weight of the major weight box.

In the tower frame transmitting pumping unit without guiding wheels of the present invention, the diameter D of the rope wheel, 1400 mm≤D≤2100 mm; the diameter d of the weight hauling cable and the driving rope, 14 mm≤d≤26 mm; and a ratio of D to d is between 70 and 130.

In the tower frame transmitting pumping unit without guiding wheels of the present invention, the powering system is a permanent magnet synchronous braking motor.

In the tower frame transmitting pumping unit without guiding wheels of the present invention, the controlling system is provided in the permanent magnet synchronous braking motor.

In the tower frame transmitting pumping unit without guiding wheels of the present invention, the sliding blocks are made of stainless steel or polytetrafluoroethylene.

Different from conventional arts, the tower frame transmitting pumping unit without guiding wheels of the present invention uses the rope wheel having a relatively big diameter to replace guiding wheels to ensure the distance between the tower frame and the well mouth is more than 700 mm and enlarge a bending diameter of the steel wires to realize expected results of the duration of the steel wires; the operation platform can be a relatively movable tower frame, wherein the operation platform is moved away from the well mouth before drilling to move the rope wheel away from the well mouth; the hanging part of the weight hauling cable is provided at the longitudinal center of the tower frame to fully use an internal space of the tower frame, wherein a thickness of the balancing weight box is reduced to be possibly small while a volume thereof is kept unchanged to possibly lower a height of the tower frame, or cheap weight materials are used to save costs.

In the tower frame transmitting pumping unit without guiding wheels of the present invention, the platform moving device formed by a combination of the sliding sleeves and the sliding tracks formed by round pipes is most simple and reliable; the operation platform positioning board provided on the first sliding tracks, the second sliding tracks or the sliding tracks formed by round pipes are for limiting a range for the operation platform to move backward to ensure production safety; the transmitting system transmits power to the transmitting shaft through a first-class deceleration via a chain and then drives the rope wheel shaft through a second-class deceleration via a pair of gears, so as to drive the driving rope of the suction rod and the weight hauling cable fixedly twining on the rope wheel, in such a manner that the suction rod and the balancing weight box move upwardly and downwardly to finish exploiting; using the chain for the first-class deceleration has advantages of reducing power loss and keeping a relatively high working efficiency under a condition of heavy loading; the big gear ring for driving the rope wheel to roll is mounted at the central part of the external side of the rope wheel, in such a manner that a main axle and the driving rope twining at two ends of the rope wheel are stressed in a balance during the whole operation process; the devices on the whole operation platform are more compact and have a more stable center of gravity; simultaneously, the big gear ring replaces gears to reduce an area of the operation platform and reduce the cost of the whole pumping unit to some extent; the balancing weight box comprises a major weight box and the plurality of vice weight blocks to adjust the weight to multiple levels, wherein the weight is adjusted to match the powering system according to changes of the loading to reach a working state of low consumption and high efficiency; and the ratio of the diameter of the rope wheel and the diameter of the steel wires is controlled between 70 and 100, so as to improve the duration of the steel wires by 2.5 times to 5 times.

Combined with drawings, further illustration about the tower frame transmitting pumping unit without guiding wheels of the present invention is as follows.

DETAILED DESCRIPTION OF THE PREFERRED EMBODIMENT

Figure 2:
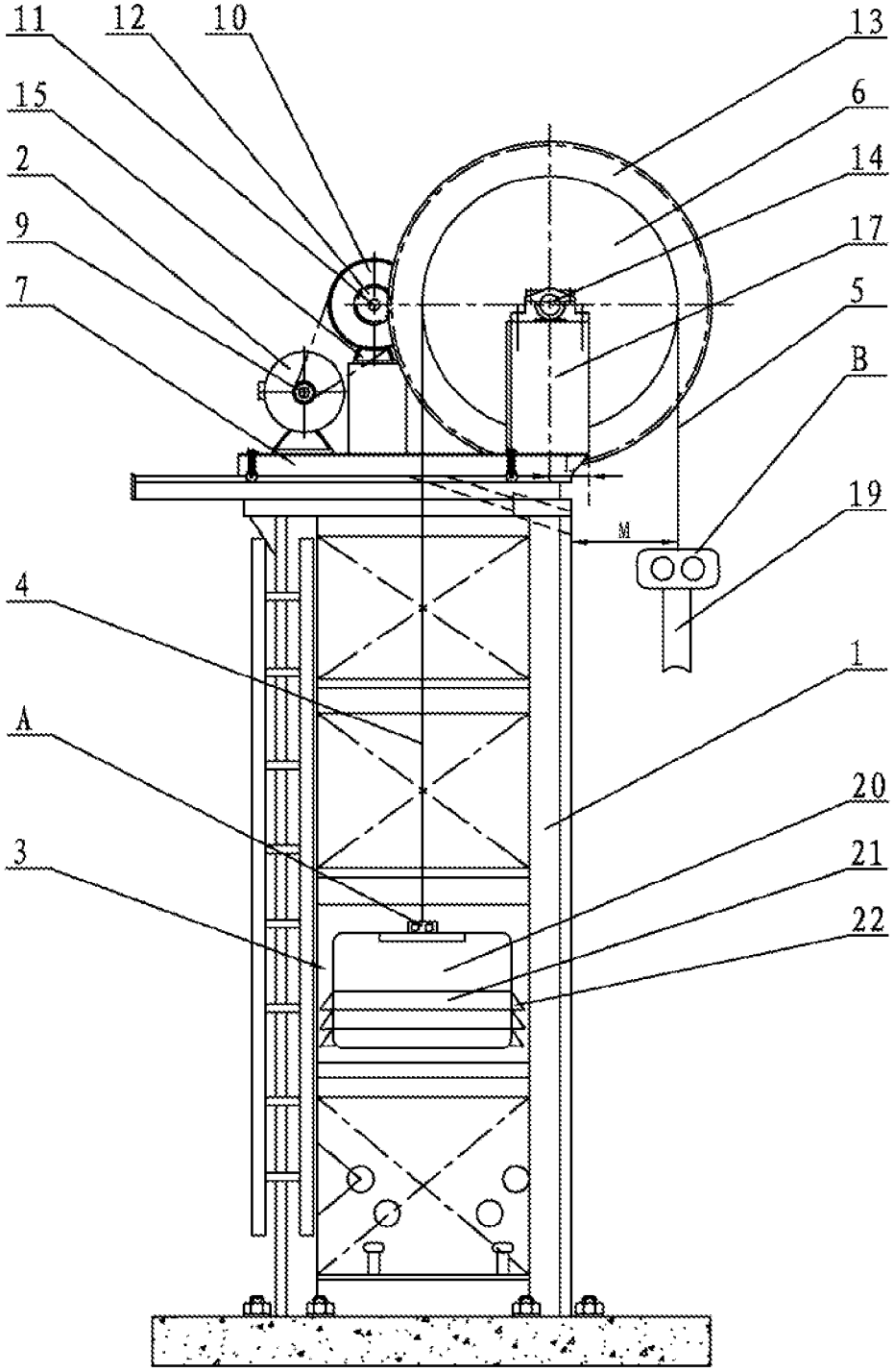
FIG. 2 is a front view of a tower frame combined transmitting pumping unit without guiding wheels according to a first preferred embodiment of the present invention.
Figure 3:
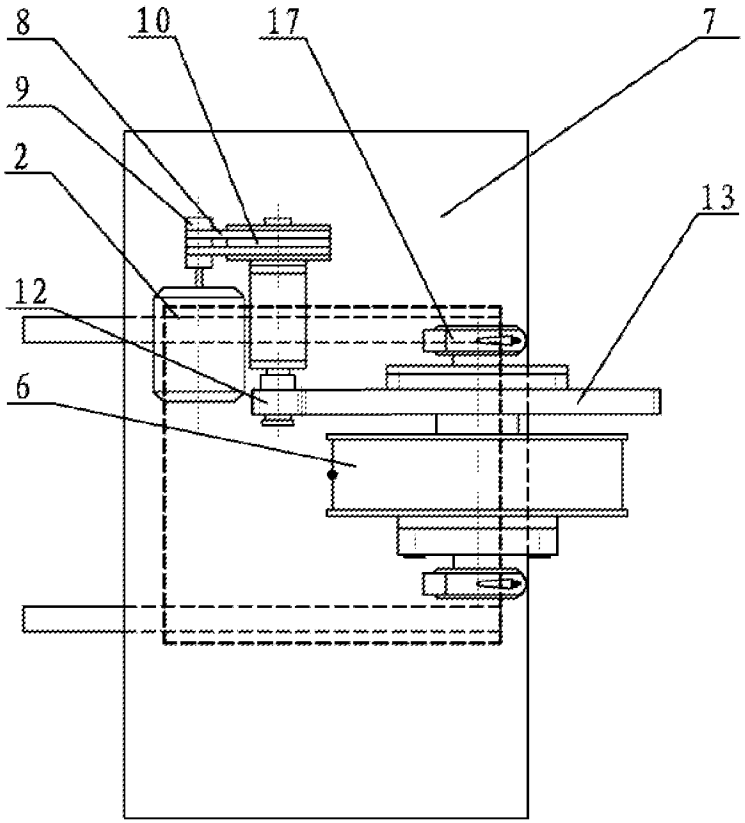
FIG. 3 is a top view of FIG. 2.
Figure 7:
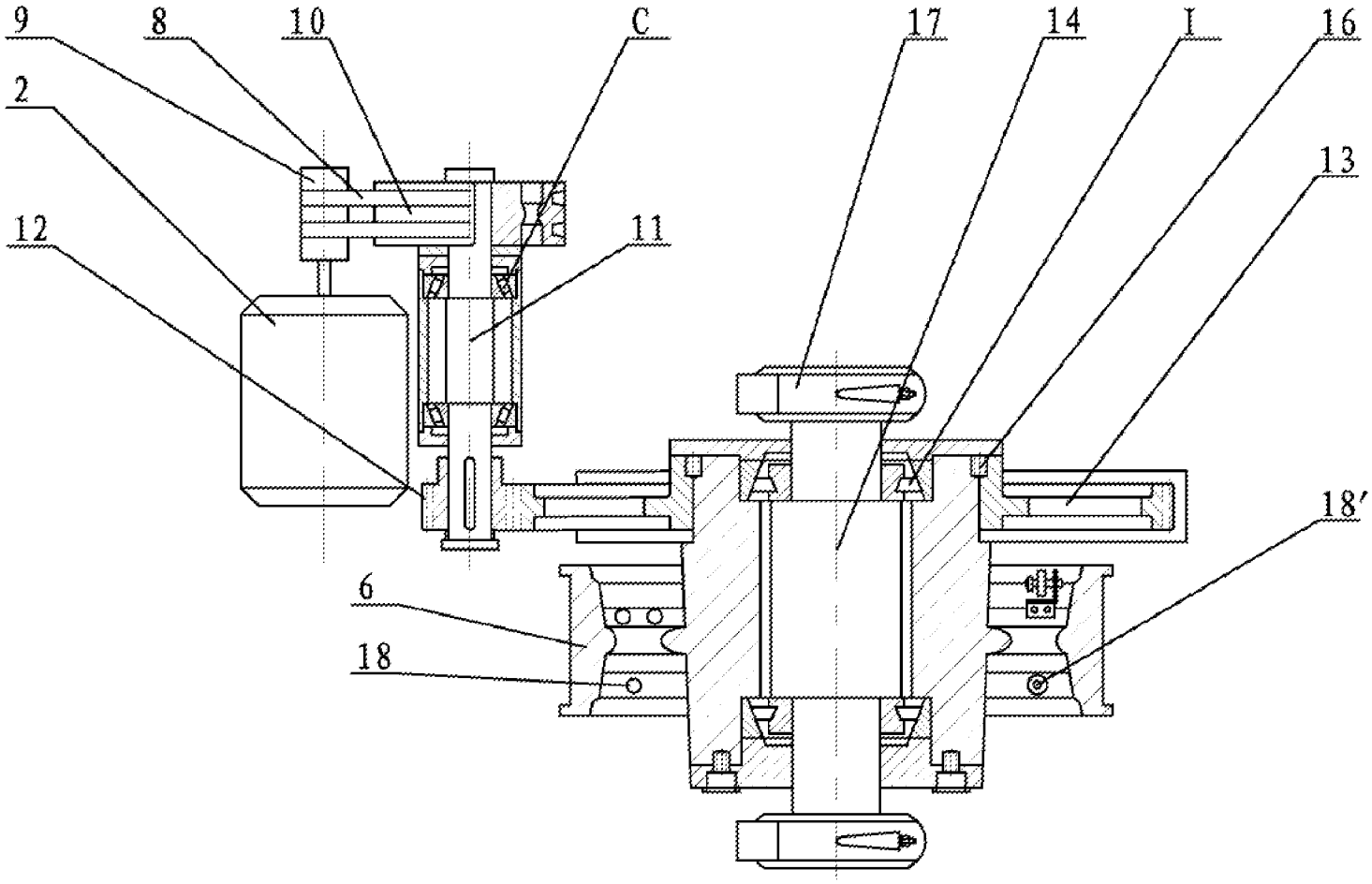
FIG. 7 is a structural schematic view of a transmitting system according to the first preferred embodiment of the present invention.

Referring to FIGS. 2 and 3 of the drawings, according to a first preferred embodiment of the present invention, a tower frame combined transmitting pumping unit without guiding wheels comprises a tower frame 1, a powering system 2, a transmitting system, a controlling system, a balancing weight box 3, a weight hauling cable 4, a driving rope 5 and rope hangers, wherein the powering system 2, the transmitting system and the rope wheel 6 are installed on an operation platform 7 at a top of the tower frame 1; the powering system 2 is a permanent magnet synchronous braking motor; the controlling system is installed in the permanent magnet synchronous braking motor; and the whole tower frame combined transmitting pumping unit without guiding wheels is controlled and operated through wireless or cable controllers by operators below the tower frame 1. Combined with FIG. 7, the transmitting system comprises a transmitting belt 8, a small belt chain wheel 9, a big belt chain wheel 10, a transmitting shaft 11, a small gear 12, a big gear 13 and a rope wheel shaft 14. An outputting terminal of the powering system 2 is fixedly connected to the small belt chain wheel 9. The small belt chain wheel 9 drives the big belt chain wheel 10 through the transmitting belt 8. The big belt chain wheel 10 is mounted on a first end of the transmitting shaft 11. The small gear 12 is mounted on a second end of the transmitting shaft 11. The transmitting shaft 11 is installed on a transmitting shaft holder 15 through a first pair of bearings C. The small gear 12 and the big gear 13 engage with each other. The big gear 13 is mounted on an end of the rope wheel 6 through a dowel 16. A rope wheel shaft 14 is provided in an internal part of the rope wheel 6 through a second pair of bearings I. Two ends of the rope wheel shaft 14 are respectively mounted on a shaft seat 17 which is fixed on the operation platform 7. A central axis line of the rope wheel 6 is located within an edge of the operation platform 7. A minimum distance between the central axis line and the edge of the operation platform along a horizontal direction is counted as L. L is embodied as 100 mm. A wheel rim of the rope wheel 6 extends beyond the operation platform 7 and a minimum distance between a most external rim thereof and the tower frame 1 along a horizontal direction is counted as M. M is embodied as 800 mm. The rope wheel 6 has a plurality of fixing holes 18 and 18'. An end of the weight hauling cable 4 is fixed on a first group of the fixing holes 18. An end of the driving rope 5 is fixed on a second group of the fixing holes 18'. The weight hauling cable 4 and the driving rope 5 twine around the rope wheel 6 reversely. A free end of the weight hauling cable 4 is connected to the balancing weight box 3 through a first rope hanger A and a hanging part of the weight hauling cable 4 is located at a longitudinal center of the tower frame 1. A free end of the driving rope 5 is connected to a suction rod 19 through a second rope hanger B. The balancing weight box 3 comprises a major weight box 20 and a plurality of vice weight blocks 21 of multiple level, wherein the plurality of vice weight blocks 21 are attached on the major weight box 20 through hangers 22 installed at two sides of the major weight box 20; cement, sand and iron are provided in the major weight box 20 and the plurality of vice weight blocks 21; a total weight of the plurality of vice weight blocks 21 is smaller than 10% of a total weight of the major weight box 20. According to an actual loading of the suction rod 19, the weight of the balancing weight box 3 is adjusted by operators, so as to reach a relatively balanced working state of the suction rod 19 and the weight to further reduce energy consumption of the powering system 2 and the transmitting system.

Figure 4:
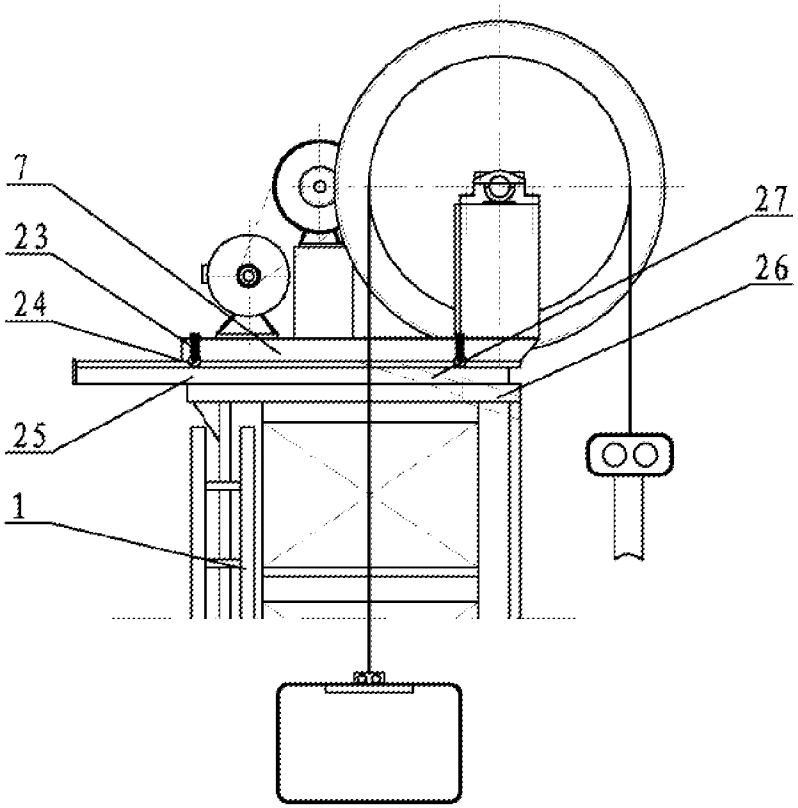
FIG. 4 is a sketch view of a platform moving device according to the first preferred embodiment of the present invention.

As showed in FIG. 4, a platform moving device is provided between the operation platform 7 and the top of the tower frame 1. The platform moving device comprises jackscrews 23, pulleys 24 and sliding tracks 25, wherein the jackscrews 23 are uprightly installed in the operation platform 7; lower ends of the jackscrews 23 are connected to a rotation axle of the pulley 24; the sliding tracks 25 are riveted on the top of the tower frame 1; and the sliding tracks 25 and the pulley 24 cooperate with each other. A hydraulic piston cylinder is installed between the top of the tower frame 1 and the operation platform 7; the piston cylinder 26 is hinged on the top of the tower frame 1; and an end of a piston rod 27 is hinged on the operation platform 7. Before drilling, the jackscrew 23 is rotated by operators to push the operation platform 7 away from the tower frame 1, and the hydraulic piston cylinder is started to force the operation platform 7 to move away from a well mouth via the piston rod 27, so as to empty the well mouth.

Figure 6:
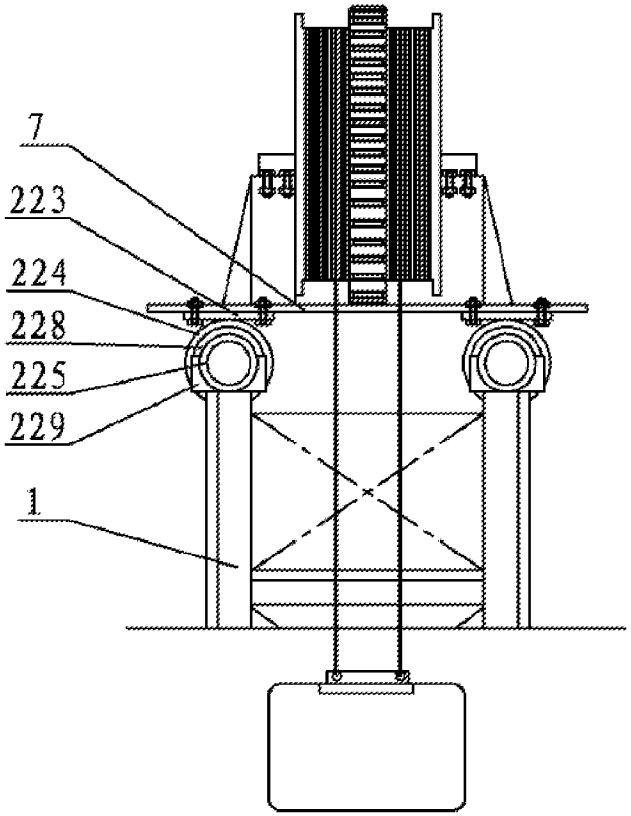
FIG. 6 is a right view of FIG. 5.
Figure 5:
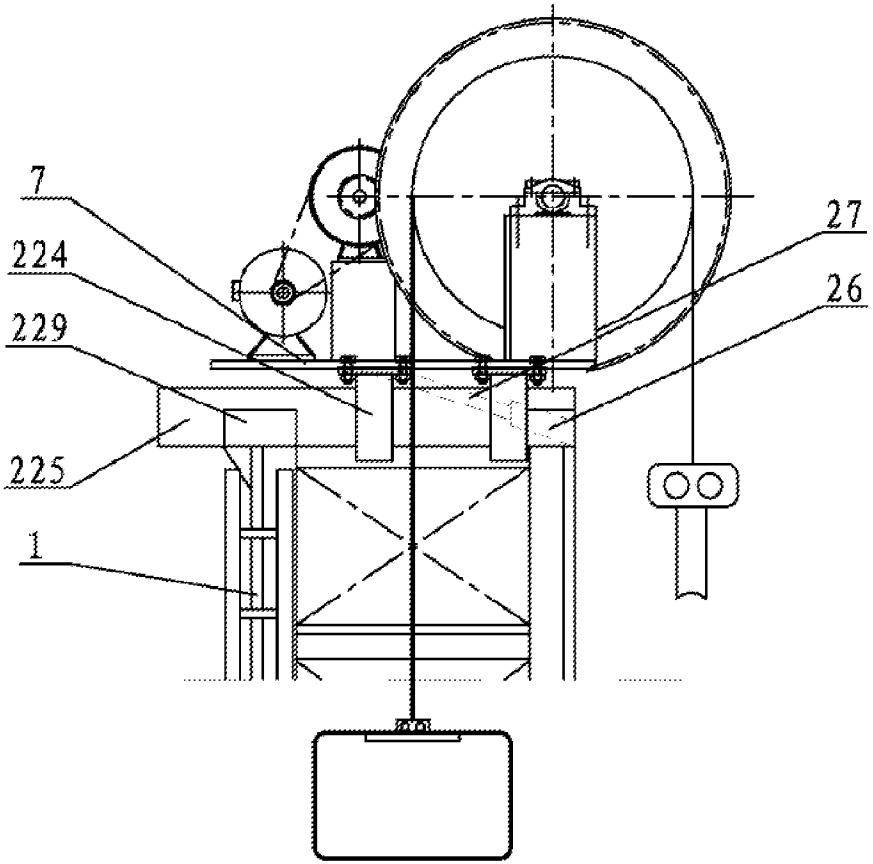
FIG. 5 is a sketch view of the platform moving device according to a second preferred embodiment of the present invention.

As showed in FIGS. 5 and 6, according to a second preferred embodiment of the present invention, the platform moving device comprises sliding tracks 225 formed by round pipes and sliding sleeves 224. The sliding tracks 225 formed by round pipes are installed at the top of the tower frame 1; the sliding sleeves 224 are connected to a bottom of the operation platform 7 through a connecting board 223 on a top thereof and screw bolts on the connecting board 223; the sliding sleeves 224 are sleeved on the sliding tracks 225 formed by round pipes and able to slide on the sliding tracks 225 formed by round pipes. Copper sleeves 228 are further sleeved between the sliding sleeves 224 and the sliding tracks 225 formed by round pipes. The copper sleeves 228 are embedded in an internal wall of the sliding sleeves 224 and lubricant is applied between the copper sleeves 228 and the sliding tracks 225 formed by round pipes. Two operation platform positioning boards 229 are provided on each sliding track 225 formed by round pipes. The sliding sleeves 224 are only able to move between two operation platform positioning boards 229.

According to a third preferred embodiment, not showed in the drawings, the platform moving device comprises sliding tracks and sliding blocks. The sliding tracks are riveted on the top of the tower frame. The operation platform is provided on the sliding tracks. The sliding blocks are provided between the operation platform and the sliding tracks. The sliding blocks are attached or riveted on the sliding tracks and a bottom of the operation platform, or attached or riveted on the sliding tracks or the bottom of the operation platform. The sliding blocks are made of highly lubricant and abrasion resistant metal or engineering plastic, such as stainless steel and polytetrafluoroethylene (PTFE).

Figure 1:
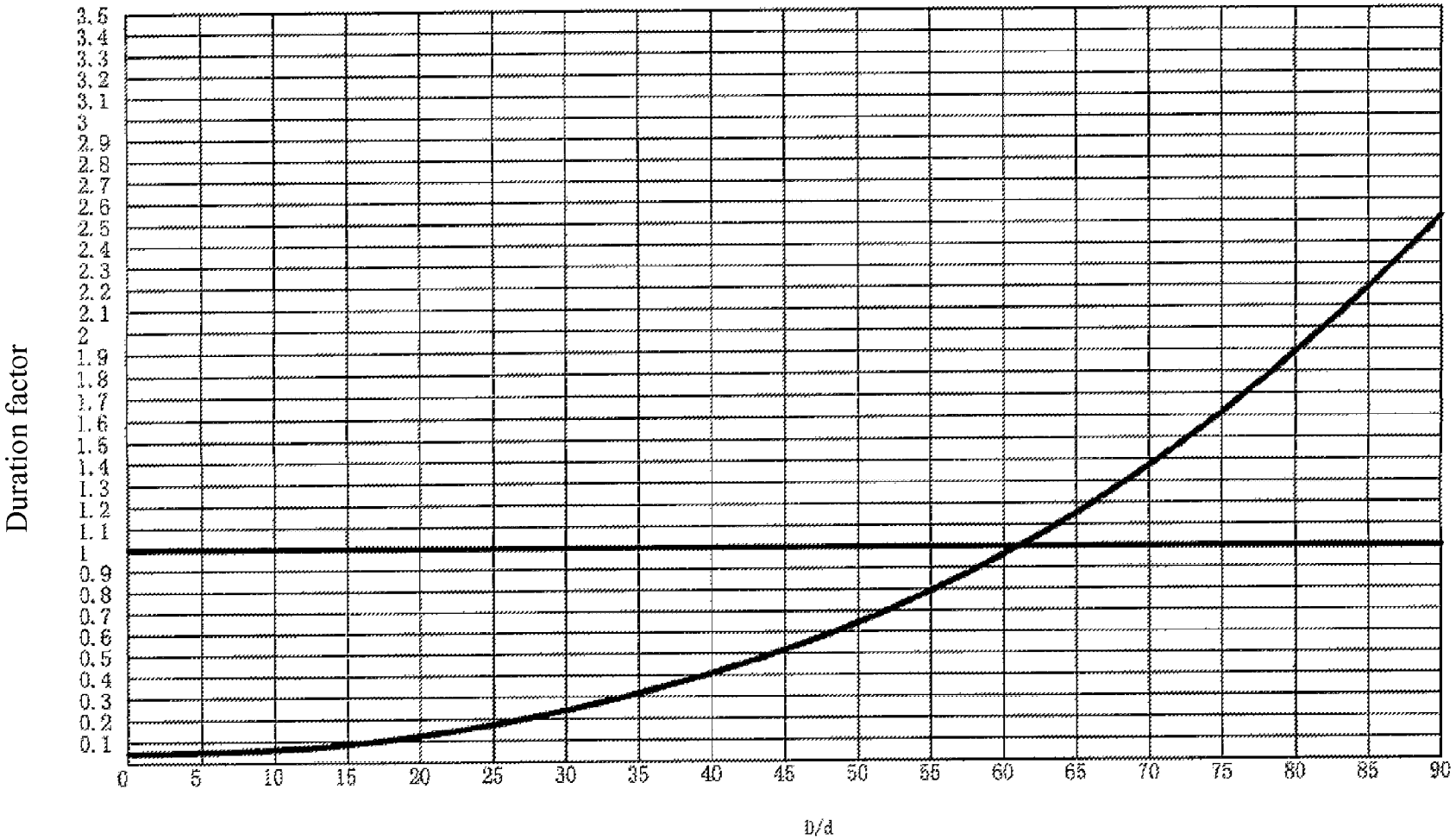
FIG. 1 is a diagram of duration factor relative to bending fatigue of steel wires according to preferred embodiments of the present invention.

In the above preferred embodiments of the present invention, a diameter D of the rope wheel 6 is around 1800 mm; a diameter d of steel wires of the weight hauling cable 4 and the driving rope 5 is 20 mm; and thus D/d is 90. According to FIG. 1, a duration factor thereof is 2.5, which means the duration thereof is greatly improved.

Figure 8:
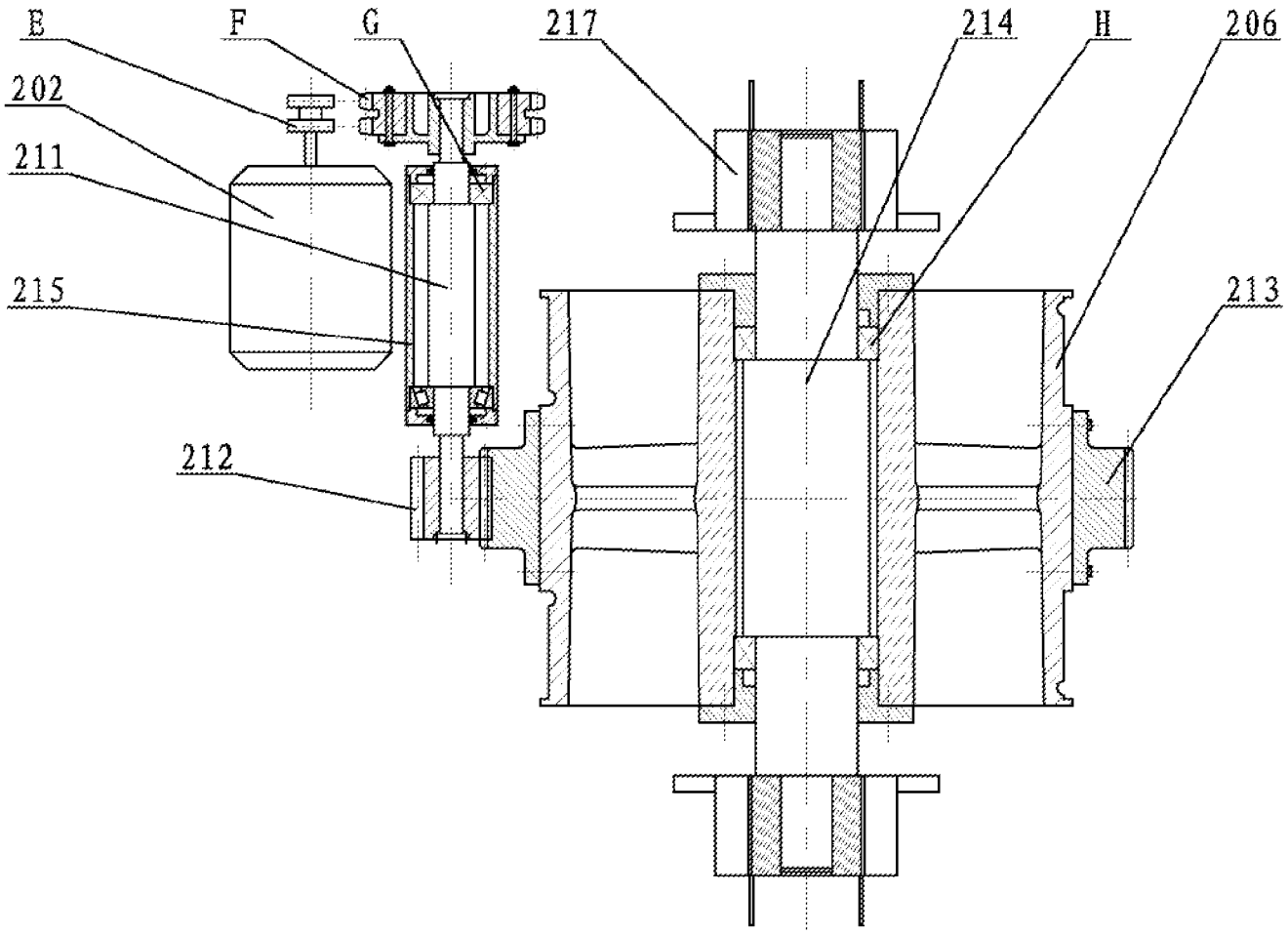
FIG. 8 is a structural schematic view of the transmitting system according to the second preferred embodiment of the present invention.

As showed in FIG. 8, according to the second preferred embodiment of the present invention, a first chain wheel E and a second chain wheel F of the transmitting system replace the small belt chain wheel 9 and the big belt chain wheel 10 of the first preferred embodiment of the present invention; a big gear ring 213 replaces the big gear 13 of the first embodiment of the present invention. The first chain wheel E is installed on an outputting terminal of the powering system 202; the first chain wheel E drives the second chain wheel F through a chain. The second chain wheel F is mounted on a first end of the transmitting shaft 211. A small gear 212 is mounted on a second end of the transmitting shaft 211. The transmitting shaft 211 is installed on the transmitting shaft holder 215 through a first pair of bearings G. The big gear ring 213 is mounted on a central part of an external side of the rope wheel 206. The rope wheel 206 is installed on the rope wheel shaft 214 through a second pair of bearings H. Two ends of the rope wheel shaft 214 are respectively mounted on a shaft seat 217. The small gear 212 and the big gear ring 213 engage with each other.

The diameter d of the steel wires of the weight hauling cable 4 and the driving rope 5 is between 14 mm and 26 mm and is adjusted based on practical loading. The diameter D of the rope wheel 6 is ranged from 1400 mm to 2100 mm so as to ensure that M is not smaller than 700 mm; and the ratio of D to d is controlled between 70 and 130 to contribute to improving the duration of the steel wires.

The examples above are only used to describe the preferred embodiments and are not intended to limit the present invention. It will be understood that various changes and modifications made by those skilled in the art will fall within the spirit and scope of the present invention as defined by the appended claims without departing the sprit of the present invention.

Technical Utility

The tower frame combined transmitting pumping unit without guiding wheels of the present invention mainly solves the problem of the duration of the steel wires, especially for the tower frame pumping units having a loading over than 12 tons and elongates the duration of the steel wires, which surely contributes to reducing production costs and improving production efficiency. Thus the present invention has a great market prospect and a strong technical utility.

What is claimed is:

1. A tower frame combined transmitting pumping unit without guiding wheels, comprising a tower frame, a powering system, a transmitting system, a controlling system, a balancing weight box, a weight hauling cable, a rope wheel, a driving rope and rope hangers, wherein said powering system, said transmitting system, said controlling system and said rope wheel are installed on an operation platform on a top of said tower frame; said controlling system, connected to said powering system, is for controlling commutation positions and rotation speeds of said powering system; said powering system is transmittedly connected to said rope wheel through said transmitting system; wherein said rope wheel is fixed on a side of said operation platform through a rope wheel supporting device; a central axis line of said rope wheel is located within an edge of said operation platform; a minimum distance between said central axis line and said edge of said operation platform along a horizontal direction is counted as L; a wheel rim of said rope wheel extends beyond said operation platform; a minimum distance between a most external rim thereof and said tower frame along a horizontal direction is counted as M; said rope wheel has several fixing holes; an end of said weight hauling cable is fixed on a first group of said fixing holes and an end of said driving rope is fixed on a second group of said fixing holes; said weight hauling cable and said driving rope twine around said rope wheel reversely; a free end of said weight hauling cable is connected to said balancing weight box through a first rope hanger A and a hanging part of said weight hauling cable is located at a longitudinal center of said tower frame; a free end of said driving rope is connected to a suction rod through a second rope hanger B; and a platform moving device is provided between said operation platform and said top of said tower frame, wherein L is not smaller than 50 mm and M is not smaller than 700 mm; said platform moving device comprises sliding tracks formed by round pipes and sliding sleeves; said sliding tracks formed by round pipes are mounted on said top of said tower frame; said sliding sleeves are connected to a bottom of said operation platform through a connecting board at a top thereof; and the sliding sleeves are sleeved on said sliding tracks formed by round pipes and able to slide on said sliding tracks formed by round pipes.

2. The tower frame combined transmitting pumping unit without guiding wheels, as recited in claim 1, wherein copper sleeves are further provided between said sliding sleeves and said sliding tracks formed by round pipes; said copper sleeves are connected to an internal wall of said sliding sleeves and lubricant is applied between said copper sleeves and said sliding tracks formed by round pipes.

3. The tower frame combined transmitting pumping unit without guiding wheels, as recited in claim 2, wherein operation platform positioning boards are provided on said top of said tower frame; said operation platform positioning boards are installed on said sliding tracks formed by round pipes to be movable.

4. The tower frame combined transmitting pumping unit without guiding wheels, as recited in claim 2, wherein said transmitting system comprises a transmitting belt, a small belt chain wheel, a big belt chain wheel, a transmitting shaft, a small gear, a big gear and a rope wheel shaft; an outputting terminal of said powering system is fixedly connected to said small belt chain wheel; said small belt chain wheel drives said big belt chain wheel through said transmitting belt; said big belt chain wheel is mounted on a first end of said transmitting shaft; said small gear is mounted on a second end of said transmitting shaft; said transmitting shaft is installed on a transmitting shaft holder through a first pair of bearings C; said small gear and said big gear engage with each other; said big gear is mounted on an end of said rope wheel through a dowel; said rope wheel shaft is installed on an internal part of said rope wheel through a second pair of bearings I; two ends of said rope wheel shaft are respectively fixed on a shaft seat; said shaft seat is fixed on said operation platform; said rope wheel shaft, said second pair of bearings I and said shaft seat form a rope wheel supporting device.

5. The tower frame combined transmitting pumping unit without guiding wheels, as recited in claim 1, wherein a hydraulic piston cylinder is installed between said top of said tower frame and said operation platform; said piston cylinder is hinged on said top of said tower frame; and an end of a piston rod of said piston cylinder is hinged on said operation platform.

6. The tower frame combined transmitting pumping unit without guiding wheels, as recited in claim 2, wherein a hydraulic piston cylinder is installed between said top of said tower frame and said operation platform; said piston cylinder is hinged on said top of said tower frame; and an end of a piston rod of said piston cylinder is hinged on said operation platform.

7. The tower frame combined transmitting pumping unit without guiding wheels, as recited in claim 1, wherein said balancing weight box is provided with a major weight box and a plurality of vice weight blocks of multiple levels; said plurality of vice weight blocks are attached to said major weight box through hangers installed at two sides of said major weight box; any one of cement sand, and iron are provided in said major weight box and said plurality of vice weight blocks; and a total weight of said plurality of vice weight blocks is smaller than 10% of a total weight of said major weight box.

8. The tower frame combined transmitting pumping unit without guiding wheels, as recited in claim 2, wherein said balancing weight box is provided with a major weight box and a plurality of vice weight blocks of multiple levels; said plurality of vice weight blocks are attached to said major weight box through hangers installed at two sides of said major weight box; any one of cement, sand, and iron are provided in said major weight box and said plurality of vice weight blocks; and a total weight of said plurality of vice weight blocks is smaller than 10% of a total weight of said major weight box.

9. The tower frame combined transmitting pumping unit without guiding wheels, as recited in claim 1, wherein D is a diameter of said rope wheel and 1400 mm D 2100 mm; d is a diameter of said weight hauling cable and said driving rope and 14 mm d 26 mm; and a ratio of D to d is between 70 and 130.

10. The tower frame combined transmitting pumping unit without guiding wheels, as recited in claim 2, wherein D is a diameter of said rope wheel and 1400 mm D 2100 mm; d is a diameter of said weight hauling cable and said driving rope and 14 mm d 26 mm; and a ratio of D to d is between 70 and 130.

11. The tower frame combined transmitting pumping unit without guiding wheels, as recited in claim 1, wherein said powering system is a permanent magnet synchronous braking motor.

12. The tower frame combined transmitting pumping unit without guiding wheels, as recited in claim 11, wherein said controlling system is provided in said permanent magnet synchronous braking motor.

* * * * *